US011802259B2

(12) United States Patent
Miracle et al.

(10) Patent No.: US 11,802,259 B2
(45) Date of Patent: Oct. 31, 2023

(54) PROCESS OF REDUCING MALODORS ON FABRICS

(71) Applicant: The Procter & Gamble Company, Cincinnati, OH (US)

(72) Inventors: Gregory Scot Miracle, Liberty Township, OH (US); Patrick Christopher Stenger, Fairfield, OH (US); Fabrizio Meli, Montgomery, OH (US); Giulia Ottavia Bianchetti, Brussels (BE)

(73) Assignee: The Procter & Gamble Company, Cincinnati, OH (US)

( * ) Notice: Subject to any disclaimer, the term of this patent is extended or adjusted under 35 U.S.C. 154(b) by 126 days.

(21) Appl. No.: 17/086,488

(22) Filed: Nov. 2, 2020

(65) Prior Publication Data

US 2021/0139816 A1 May 13, 2021

Related U.S. Application Data

(60) Provisional application No. 62/932,518, filed on Nov. 8, 2019.

(51) Int. Cl.

| | |
|---|---|
| ***D06L 1/12*** | (2006.01) |
| ***C11D 3/00*** | (2006.01) |
| ***C11D 3/04*** | (2006.01) |
| ***C11D 3/20*** | (2006.01) |
| ***C11D 3/40*** | (2006.01) |
| ***C11D 1/831*** | (2006.01) |
| ***C11D 3/28*** | (2006.01) |
| ***C11D 3/32*** | (2006.01) |
| ***C11D 11/00*** | (2006.01) |
| *C11D 1/22* | (2006.01) |
| *C11D 1/29* | (2006.01) |
| *C11D 1/72* | (2006.01) |
| *C11D 1/75* | (2006.01) |

(52) U.S. Cl.

CPC ..... *C11D 3/0084* (2013.01); *C11D 1/831* (2013.01); *C11D 3/0068* (2013.01); *C11D 3/046* (2013.01); *C11D 3/2093* (2013.01); *C11D 3/2096* (2013.01); *C11D 3/28* (2013.01); *C11D 3/32* (2013.01); *C11D 3/40* (2013.01); *C11D 11/0017* (2013.01); *D06L 1/12* (2013.01); *C11D 1/22* (2013.01); *C11D 1/29* (2013.01); *C11D 1/72* (2013.01); *C11D 1/75* (2013.01)

(58) Field of Classification Search
None
See application file for complete search history.

(56) References Cited

U.S. PATENT DOCUMENTS

| | | | | |
|---|---|---|---|---|
| 3,700,401 | A * | 10/1972 | Spangler et al. | C11D 3/386 510/306 |
| 5,302,310 | A * | 4/1994 | Houghton | C11D 3/1253 510/438 |
| 2003/0073771 | A1* | 4/2003 | Sanders | C07C 37/88 524/304 |
| 2006/0183658 | A1* | 8/2006 | Sadlowski | C11D 3/40 510/392 |
| 2008/0318828 | A1* | 12/2008 | Boerefijn | C11D 3/0084 510/276 |
| 2015/0337244 | A1* | 11/2015 | Kita | C11D 3/2041 510/340 |
| 2018/0119065 | A1* | 5/2018 | Miracle | C09B 57/00 |
| 2020/0063066 | A1* | 2/2020 | Depoot | C11D 3/0084 |
| 2020/0299888 | A1 | 9/2020 | Sivik et al. | |
| 2020/0347321 | A1 | 11/2020 | Miracle | |

FOREIGN PATENT DOCUMENTS

| | | | |
|---|---|---|---|
| EP | 3587546 | A1 | 1/2020 |
| WO | 9856890 | A1 | 12/1998 |
| WO | WO 2005/054422 | A1 * | 6/2005 |

OTHER PUBLICATIONS

JP 2011168732-A, Ozaki Kazuyoshi et al., published Sep. 1, 2011, with English translation.*
PCT Search Report and Written Opinion for PCT/US2020/059271 dated Mar. 17, 2021, 10 pages.

* cited by examiner

*Primary Examiner* — Lorna M Douyon
(74) *Attorney, Agent, or Firm* — Carolyn S. Powell

(57) ABSTRACT

A process of reducing malodors on fabrics includes combining fabrics having at least one source of malodor with a wash liquor having metal ions. The wash liquor is prepared by diluting a laundry detergent composition in water by a factor of between 100-fold and 3000-fold. The process further includes washing the fabrics in the wash liquor using an automatic wash operation, a manual wash operation or a mixture thereof; separating the fabrics and the wash liquor from one another; and drying the fabrics. The laundry detergent composition includes from 0.001% to 5% of an alkylated phenol antioxidant, a hindered phenol antioxidant, or mixtures thereof, and at least one of said antioxidants has a log D value at pH 7 equal to or greater than 1.50.

15 Claims, 1 Drawing Sheet

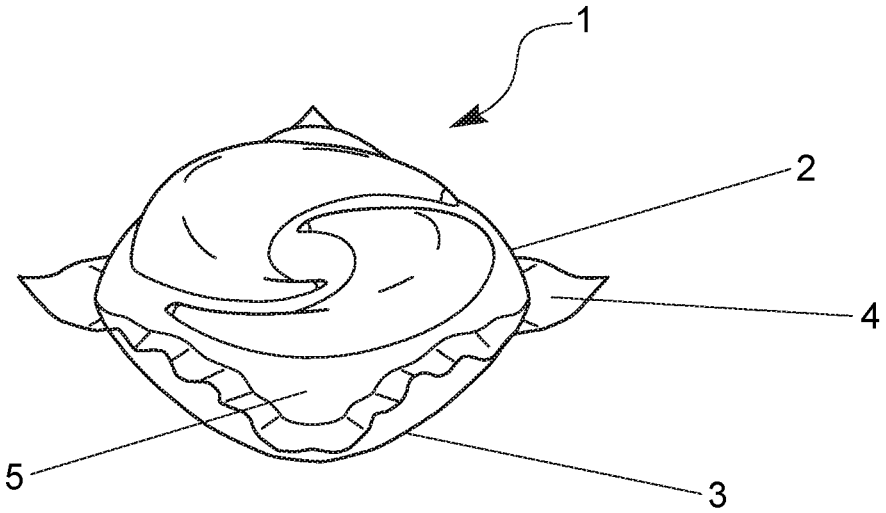
1
2
4
5
3

PROCESS OF REDUCING MALODORS ON FABRICS

FIELD OF THE INVENTION

The present invention relates to a process for reducing malodors on fabrics using a detergent composition containing an antioxidant and use of said antioxidant and said process.

BACKGROUND OF THE INVENTION

Laundry wash processes are designed to eliminate soils from fabrics. Some soils can cause malodors on fabrics and in some instances these malodors can persist even after the laundry wash operation.

Therefore, there is an on-going need for processes to reduce malodors on fabrics.

It was surprisingly found that the process according to the present invention provided reduced malodors on fabrics.

Without wishing to be bound by theory, it is believed that it is the combination of the specific choice of antioxidant according to the present invention in combination with a metal ion that provides the reduced malodor benefit on the fabrics through the wash.

SUMMARY OF THE INVENTION

A first aspect of the present invention is a process of reducing malodors on fabrics, comprising the steps of;

a. Combining fabrics with a wash liquor, wherein the fabrics comprise at least one source of malodor and wherein the wash liquor comprises a source of metal ions, preferably $Cu^{2+}$ and wherein the wash liquor is prepared by diluting a laundry detergent composition in water by a factor of between 100 and 3000 fold, preferably between 300 and 900 fold;

b. Washing the fabrics in the wash liquor using an automatic wash operation, a manual wash operation of a mixture thereof, preferably an automatic wash operation;

c. Separating the fabrics and the wash liquor from one another;

d. Drying the fabrics;

wherein the laundry detergent composition comprises between 0.01% to 5% by weight of the laundry detergent composition of an antioxidant, wherein the antioxidant is an alkylated phenol.

A second aspect of the present invention is the use of an antioxidant to reduce malodors on fabrics wherein the fabric comprises at least one source of malodor and the antioxidant is a hindered phenol.

A third aspect of the present invention is the use of a process according to the present invention to reduce malodor on fabrics in a wash liquor and wherein the fabrics comprise at least one source of malodor and wherein the wash liquor comprises a metal ion, preferably Cu'.

BRIEF DESCRIPTION OF THE DRAWINGS

FIG. 1 is a water-soluble unit dose article according to the present invention.

DETAILED DESCRIPTION OF THE INVENTION

Process

The present invention is to a process of reducing malodors on fabrics.

A 'malodor' in the context of the present invention is an undesired or undesirable smell on the fabrics. Those skilled in the art will be aware of what an undesirable smell is as compared to a desirable smell.

The process comprises the steps of;

a. Combining fabrics with a wash liquor, wherein the fabrics comprise at least one source of malodor and wherein the wash liquor comprises a source of metal ions, preferably $Cu^{2+}$ and wherein the wash liquor is prepared by diluting a laundry detergent composition in water by a factor of between 100 and 3000 fold, preferably between 300 and 900 fold. The fabric may be any suitable fabric. By fabric we preferably mean a textile or cloth comprising a network of natural or synthetic fibers. Those skilled in the art will be aware of suitable fabrics. The fabric may be selected from cotton, polyester, cotton/polyester blends, polyamide, lycra, rayon, or a mixture thereof.

The fabric comprises at least one source of malodor. Those skilled in the art will be aware of suitable sources of malodor. Sources of malodor could include the products of chemical breakdown of body soils. The source of malodor may comprise body soil or its degradation products, for example, 6-Methyl-5-heptane-2-one, Trans-2-heptanal, 3-methyl-2-Butenal, Decanoic Acid, Undecanoic Acid, Undecanal or a mixture thereof.

Those skilled in the art will know how to make the wash liquor. Without wishing to be bound by theory, addition of the laundry detergent composition to water will cause the laundry detergent composition to dissolve and create the wash liquor.

The wash liquor can be created automatically in the drum of an automatic washing machine or can be made in a manual wash operation.

The laundry detergent composition may be comprised in a water-soluble unit dose article, wherein the water-soluble unit dose article comprises a water-soluble film. Without wishing to be bound by theory, addition of the water-soluble unit dose article to water will cause the water-soluble film to dissolve and release the laundry detergent composition into the water creating the main wash liquor. When made in the drum of an automatic washing machine, traditionally, the fabrics to be washed and the water-soluble unit dose article are added to the drum and the door of the washing machine closed. The washing machine then automatically adds water to the drum to create the wash liquor.

Preferably the wash liquor comprises between 1 L and 64 L, preferably between 2 L and 32 L, more preferably between 3 L and 20 L of water.

The laundry detergent composition is described in more detail below.

The wash liquor comprises a metal ion, preferably $Cu^{2+}$. The metal ion may be present on the fabric before the fabric is contacted with the wash liquor. The metal ion may be present in the source of malodor on the fabric before the fabric is combined to the wash liquor. The metal ion may be present in the wash liquor when combined with the fabric. If present in the wash liquor, the metal ion may be present in the laundry detergent, the water or a mixture thereof. The water used to make the wash liquor may comprise between 10 ppb and 2,000 ppb, preferably between 50 ppb and 1.00 ppb of the metal ion. Without wishing to be bound by theory, tap water comprises between 10 ppb and 2,000 ppb, preferably between 50 ppb and 1,000 ppb of Cu'. The source of malodor may comprise the metal ion at the point the source of malodor is applied to the fabric. Alternatively, the source of malodor may be applied to the fabric, such as may occur during wear when fabric can be in contact with the skin of the wearer, and the metal ion applied later.

Preferably, the wash liquor comprises from 0.1 ppm to 100 ppm, preferably from 0.15 ppm to 50 ppm of the antioxidant.

b. Washing the fabrics in the wash liquor using an automatic wash operation, a manual wash operation of a mixture thereof, preferably an automatic wash operation.

Those skilled in the art will know how to wash fabrics in an automatic wash operation, a manual wash operation or a mixture thereof.

Preferably, the wash liquor is at a temperature of between 5° C. and 90° C., preferably between 10° C. and 60° C., more preferably between 12° C. and 45° C., most preferably between 15° C. and 40° C.

Preferably, washing the fabrics in the wash liquor takes between 5 minutes and 50 minutes, preferably between 5 minutes and 40 minutes, more preferably between 5 minutes and 30 minutes, even more preferably between 5 minutes and 20 minutes, most preferably between 6 minutes and 18 minutes to complete.

Preferably, the wash liquor comprises between 1 kg and 20 kg, preferably between 3 kg and 15 kg, most preferably between 5 and 10 kg of the fabrics.

The wash liquor may comprise water of any hardness preferably varying between 0 gpg to 40 gpg. A lower water hardness is termed soft water whereas a higher water hardness is termed hard water.

c. Separating the fabrics and the wash liquor from one another.

The fabrics and the wash liquor are separated from one another following washing of the fabrics. Such separation may involve removing the fabrics from the wash liquor, or draining the wash liquor away from the fabrics. In an automatic washing machine operation, it is preferred that the wash liquor is draining away from the fabrics. In the avoidance of doubt, some of the wash liquor may remain soaked into the fabrics following separation of the fabrics and the main wash liquor, i.e. the fabrics remain wet. With respect to the present invention the fabrics and wash liquor are deemed separated from one another once the fabric is separate from the main volume of the wash liquor or the main volume of the wash liquor has been drained away, despite some residual wash liquor possibly remaining soaked into the fabrics.

d. Rinsing the fabrics

The method may include an additional step comprising the rinsing of the fabrics by a liquid that may not contain a detergent. The additional step may serve the purpose of removing any residual wash liquor in the fabrics. The liquid used during the rinsing step may be water. Additionally, the liquid may be a combination of water with one or more additives such as a fabric softening agent.

e. Drying the fabrics.

The method may include an additional step comprising drying the fabrics. Those skilled in the art will be aware of suitable means to dry the fabrics. The fabrics may be dried by any suitable means including but not limited to: on a line (indoor or outdoor), at room temperature in an automatic drying machine or a mixture thereof. Those skilled in the art will know at what point the fabrics are deemed dry as opposed to wet.

Laundry Detergent Composition

The process according to the present invention comprises the step of diluting a laundry detergent composition.

The laundry detergent composition may be a powder, a liquid, a water-soluble unit dose article or a mixture thereof, preferably a water-soluble unit dose comprising a liquid composition.

The solid laundry detergent composition may comprise solid particulates or may be a single homogenous solid. Preferably, the solid laundry detergent composition comprises particles. This means the solid laundry detergent composition comprises individual solid particles as opposed to the solid being a single homogenous solid. The particles may be free-flowing or may be compacted, preferably free-flowing.

The term 'liquid laundry detergent composition' refers to any laundry detergent composition comprising a liquid capable of wetting and treating a fabric, and includes, but is not limited to, liquids, gels, pastes, dispersions and the like. The liquid composition can include solids or gases in suitably subdivided form, but the liquid composition excludes forms which are non-fluid overall, such as powders, tablets or granules.

The water-soluble unit dose article is described in more detail below.

The laundry detergent composition comprises between 0.001% to 5%, more preferably from 0.01% to 1%, most preferably from 0.025% to 0.5% by weight of the laundry detergent composition of an alkylated phenol or hindered phenol antioxidant. The antioxidant is described in more detail below.

The laundry detergent composition preferably comprises a non-soap surfactant. More preferably, the non-soap surfactant is selected from non-soap anionic surfactant, non-ionic surfactant, amphoteric surfactant, cationic surfactant, or a mixture thereof. The laundry detergent composition preferably comprises between 10% and 60%, more preferably between 20% and 55% by weight of the laundry detergent composition of the non-soap surfactant.

Preferably, the non-soap anionic surfactant comprises linear alkylbenzene sulphonate, alkoxylated alkyl sulphate, alkyl sulfate, or a mixture thereof. Preferably, the alkyl sulphate is an ethoxylated alkyl sulphate.

Preferably, the laundry detergent composition comprises between 5% and 50%, preferably between 15% and 45%, more preferably between 25% and 40%, most preferably between 30% and 40% by weight of the detergent composition of the non-soap anionic surfactant.

Preferably, the non-soap anionic surfactant comprises linear alkylbenzene sulphonate and alkoxylated alkyl sulphate, wherein the ratio of linear alkylbenzene sulphonate to alkoxylated alkyl sulphate preferably the weight ratio of linear alkylbenzene sulphonate to ethoxylated alkyl sulphate is from 1:2 to 20:1, preferably from 1.1:1 to 15:1, more preferably from 1.2:1 to 10:1, even more preferably from 1.3:1 to 5:1, most preferably from 1.4:1 to 3:1.

Preferably, the laundry detergent composition comprises between 0% and 10%, preferably between 0.01% and 8%, more preferably between 0.1% and 6%, most preferably between 0.15% and 4% by weight of the laundry detergent composition of a non-ionic surfactant. The non-ionic surfactant is preferably selected from alcohol alkoxylate, an oxo-synthesized alcohol alkoxylate, Guerbet alcohol alkoxylates, alkyl phenol alcohol alkoxylates or a mixture thereof.

Preferably, the laundry preferably liquid laundry detergent composition comprises between 1.5% and 20%, more preferably between 2% and 15%, even more preferably between 3% and 10%, most preferably between 4% and 8% by weight of the laundry detergent composition of soap, preferably a fatty acid salt, more preferably an amine neutralized fatty acid salt, wherein preferably the amine is an alkanolamine more preferably selected from monoethanolamine, diethanolamine, triethanolamine or a mixture thereof, more preferably monoethanolamine.

The laundry detergent composition preferably comprises an ingredient selected from the list comprising cationic polymers, polyester terephthalates, amphiphilic graft copolymers, carboxymethylcellulose, enzymes, perfumes, encapsulated perfumes, bleach or a mixture thereof. Without wishing to be bound by theory it is believed further addition of these materials can further facilitate malodor reduction.

The laundry detergent composition may comprise an adjunct ingredient, wherein the adjunct ingredient is selected from non-aqueous solvents, water, hueing dyes, aesthetic dyes, enzymes, cleaning polymers, builders like fatty acid, bleach, dispersants, dye transfer inhibitor polymers, fluorescent whitening agent, opacifier, antifoam or a mixture thereof.

The composition may comprise a hueing dye, sometimes referred to as a fabric shading agent, which are well known in the art. Suitable fabric shading agents include dyes, dye-clay conjugates, and pigments. Suitable dyes include small molecule dyes and polymeric dyes. Suitable small molecule dyes include small molecule dyes selected from the group consisting of dyes falling into the Colour Index (C.I.) classifications of Direct Blue, Direct Red, Direct Violet, Acid Blue, Acid Red, Acid Violet, Basic Blue, Basic Violet and Basic Red, or mixtures thereof. Preferred dyes include alkoxylated azothiophenes, Solvent Violet 13, Acid Violet 50 and Direct Violet 9.

Preferably, the laundry detergent composition comprises a chelant, wherein the chelant is preferably selected from phosphonates, aminocarboxylates, amino phosphonates, polyfunctionally-substituted aromatic chelating agents, or mixtures thereof, more preferably an additional chelating agent selected from DTPA (diethylenetriaminepentaacetic acid), HEDP (hydroxyethanediphosphonic acid), EDDS (ethylenediamine disuccinate (EDDS), DTPMP (diethylene triamine penta (methylene phosphonic acid)), EDTMP (ethylene diamine tetra(methylene phosphonic acid)), Tiron® (1,2-diydroxybenzene-3,5-disulfonic acid), HPNO (2-pyridinol-N-oxide), MGDA (methylglycinediacetic acid), GLDA (glutamic-N,N-diacetic acid), EDTA (ethylenediamine tetraacetate), any suitable derivative thereof, salts thereof, and mixtures thereof.

The liquid laundry detergent composition preferably has a pH between 6 and 10, more preferably between 6.5 and 8.9, most preferably between 7 and 8, wherein the pH of the liquid laundry detergent composition is measured as a 10% dilution in demineralized water at 20° C.

Water-Soluble Unit Dose Article

The water-soluble unit dose article comprises a water-soluble film and a laundry detergent composition. The laundry detergent composition and the water-soluble film are described in more detail below.

The water-soluble unit dose article comprises the water-soluble film shaped such that the unit-dose article comprises at least one internal compartment surrounded by the water-soluble film, and wherein the laundry detergent composition is present within said compartment. The unit dose article may comprise a first water-soluble film and a second water-soluble film sealed to one another such to define the internal compartment. The water-soluble unit dose article is constructed such that the laundry detergent composition does not leak out of the compartment during storage. However, upon addition of the water-soluble unit dose article to water, the water-soluble film dissolves and releases the contents of the internal compartment into the wash liquor.

The compartment should be understood as meaning a closed internal space within the unit dose article, which holds the detergent composition. During manufacture, a first water-soluble film may be shaped to comprise an open compartment into which the detergent composition is added. A second water-soluble film is then laid over the first film in such an orientation as to close the opening of the compartment. The first and second films are then sealed together along a seal region.

The unit dose article may comprise more than one compartment, even at least two compartments, or even at least three compartments. The compartments may be arranged in superposed orientation, i.e. one positioned on top of the other. In such an orientation the unit dose article will comprise three films, top, middle and bottom. Alternatively, the compartments may be positioned in a side-by-side orientation, i.e. one orientated next to the other. The compartments may even be orientated in a 'tyre and rim' arrangement, i.e. a first compartment is positioned next to a second compartment, but the first compartment at least partially surrounds the second compartment, but does not completely enclose the second compartment. Alternatively, one compartment may be completely enclosed within another compartment.

Wherein the unit dose article comprises at least two compartments, one of the compartments may be smaller than the other compartment. Wherein the unit dose article comprises at least three compartments, two of the compartments may be smaller than the third compartment, and preferably the smaller compartments are superposed on the larger compartment. The superposed compartments preferably are orientated side-by-side.

In a multi-compartment orientation, the laundry detergent composition according to the present invention may be comprised in at least one of the compartments. It may for example be comprised in just one compartment, or may be comprised in two compartments, or even in three compartments.

Each compartment may comprise the same or different compositions. The different compositions could all be in the same form, or they may be in different forms.

The water-soluble unit dose article may comprise at least two internal compartments, wherein the liquid laundry detergent composition is comprised in at least one of the compartments, preferably wherein the unit dose article comprises at least three compartments, wherein the detergent composition is comprised in at least one of the compartments.

FIG. 1 discloses a water-soluble unit dose article (1) according to the present invention. The water-soluble unit dose article (1) comprises a first water-soluble film (2) and a second water-soluble film (3) which are sealed together at a seal region (4). The laundry detergent composition (5) is comprised within the water-soluble soluble unit dose article (1).

The film of the present invention is soluble or dispersible in water. The water-soluble film preferably has a thickness of from 20 to 150 micron, preferably 35 to 125 micron, even more preferably 50 to 110 micron, most preferably about 76 micron.

Preferably, the film has a water-solubility of at least 50%, preferably at least 75% or even at least 95%, as measured by the method set out here after using a glass-filter with a maximum pore size of 20 microns:

5 grams±0.1 gram of film material is added in a pre-weighed 3 L beaker and 2 L±5 ml of distilled water is added. This is stirred vigorously on a magnetic stirrer, Labline model No. 1250 or equivalent and 5 cm magnetic stirrer, set at 600 rpm, for 30 minutes at 30° C. Then, the mixture is filtered through a folded qualitative sintered-glass filter with a pore size as defined above (max. 20 micron). The water is dried off from the collected filtrate by any conventional method, and the weight of the remaining material is determined (which is the dissolved or dispersed fraction). Then, the percentage solubility or dispersability can be calculated.

Preferred film materials are preferably polymeric materials. The film material can, for example, be obtained by casting, blow-moulding, extrusion or blown extrusion of the polymeric material, as known in the art.

Preferred polymers, copolymers or derivatives thereof suitable for use as pouch material are selected from polyvinyl alcohols, polyvinyl pyrrolidone, polyalkylene oxides, acrylamide, acrylic acid, cellulose, cellulose ethers, cellulose esters, cellulose amides, polyvinyl acetates, polycarboxylic acids and salts, polyaminoacids or peptides, polyamides, polyacrylamide, copolymers of maleic/acrylic acids, polysaccharides including starch and gelatine, natural gums such as xanthum and carragum. More preferred polymers are selected from polyacrylates and water-soluble acrylate copolymers, methylcellulose, carboxymethylcellulose sodium, dextrin, ethylcellulose, hydroxyethyl cellulose, hydroxypropyl methylcellulose, maltodextrin, polymethacrylates, and most preferably selected from polyvinyl alcohols, polyvinyl alcohol copolymers and hydroxypropyl methyl cellulose (HPMC), and combinations thereof. Preferably, the level of polymer in the pouch material, for example a PVA polymer, is at least 60%. The polymer can have any weight average molecular weight, preferably from about 1000 to 1,000,000, more preferably from about 10,000 to 300,000 yet more preferably from about 20,000 to 150,000.

Mixtures of polymers and/or copolymers can also be used as the pouch material, especially mixtures of polyvinylalcohol polymers and/or copolymers, especially mixtures of polyvinylalcohol homopolymers and/or anionic polyvinylalcohol copolymers preferably selected from sulphonated and carboxylated anionic polyvinylalcohol copolymers especially carboxylated anionic polyvinylalcohol copolymers. Most preferably the water soluble film comprises a blend of a polyvinylalcohol homopolymer and a carboxylated anionic polyvinylalcohol copolymer.

Preferred films exhibit good dissolution in cold water, meaning unheated distilled water. Preferably such films exhibit good dissolution at temperatures of 24° C., even more preferably at 10° C. By good dissolution it is meant that the film exhibits water-solubility of at least 50%, preferably at least 75% or even at least 95%, as measured by the method set out here after using a glass-filter with a maximum pore size of 20 microns, described above.

Preferred films are those supplied by Monosol under the trade references M8630, M8900, M8779, M8310.

The film may be opaque, transparent or translucent. The film may comprise a printed area.

The area of print may be achieved using standard techniques, such as flexographic printing or inkjet printing.

The film may comprise an aversive agent, for example a bittering agent. Suitable bittering agents include, but are not limited to, naringin, sucrose octaacetate, quinine hydrochloride, denatonium benzoate, or mixtures thereof. Any suitable level of aversive agent may be used in the film. Suitable levels include, but are not limited to, 1 to 5000 ppm, or even 100 to 2500 ppm, or even 250 to 2000 rpm.

Antioxidant

The fabric treatment composition comprises an antioxidant. Antioxidants are substances as described in Kirk-Othmer (Vol. 3, page 424) and in Ullmann's Encyclopedia (Vol. 3, page 91). The fabric treatment composition comprises a level of antioxidant sufficient to provide at least 25 ppb, preferably at least 100 ppb, more preferably at least 250 ppb, even more preferably at least 500 ppb, even more preferably at least 1000 ppb, antioxidant concentration in the treatment liquor. The level of antioxidant may be from about 0.001% to about 50%, by weight of the fabric treatment composition.

The antioxidant may be selected from the group consisting of alkylated phenols.

Alkylated phenols may have the general formula:

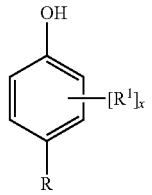

wherein $R^1$ is a $C_3$-$C_6$ branched alkyl, preferably tert-butyl; x is 1 or 2; and R is a $C_1$-$C_{22}$ linear alkyl or a $C_3$-$C_{22}$ branched alkyl, each (1) having optionally therein one or more ester (—$CO_2$—) or ether (—O—) links, and (2) optionally substituted by an organic group comprising an alkyleneoxy or polyalkyleneoxy group selected from EO, PO, BO, and mixtures thereof, more preferably from EO alone or from EO/PO mixtures; in an aspect R is preferably methyl or branched $C_3$-$C_6$ alkyl, $C_1$-$C_6$ alkoxy, preferably methoxy.

The alkylated phenol may be a hindered phenol. As used herein, the term "hindered phenol" is used to refer to a compound comprising a phenol group with either (a) at least one $C_3$ or higher branched alkyl, preferably a $C_3$-$C_6$ branched alkyl, preferably tert-butyl, attached at a position ortho to at least one phenolic —OH group, or (b) substituents independently selected from the group consisting of a $C_1$-$C_6$ alkoxy, preferably methoxy, a $C_1$-$C_{22}$ linear alkyl or $C_3$-$C_{22}$ branched alkyl, preferably methyl or branched $C_3$-$C_6$ alkyl, or mixtures thereof, at each position ortho to at least one phenolic —OH group. If a phenyl ring comprises more than one —OH group, the compound is a hindered phenol provided at least one such —OH group is substituted as described immediately above.

A further class of hindered phenol antioxidants suitable for use in the composition is a benzofuran or benzopyran derivative having the formula:

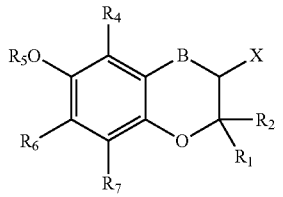

wherein $R_1$ and $R_2$ are each independently alkyl or $R_1$ and $R_2$ can be taken together to form a $C_5$-$C_6$ cyclic hydrocarbyl moiety; B is absent or $CH_2$; $R_4$ is $C_1$-$C_6$ alkyl; $R_5$ is hydrogen or —C(O)$R_3$ wherein $R_3$ is hydrogen or $C_1$-$C_{19}$ alkyl; $R_6$ is $C_1$-$C_6$ alkyl; $R_7$ is hydrogen or $C_1$-$C_6$ alkyl; X is —$CH_2H$, or —$CH_2A$ wherein A is a nitrogen comprising unit, phenyl, or substituted phenyl. Preferred nitrogen comprising A units include amino, pyrrolidino, piperidino, morpholino, piperazino, and mixtures thereof.

Suitable hindered phenols for use herein include, but are not limited to, 3,3'-bis(1,1-dimethylethyl)-5,5'-dimethoxy-[1,1'-Biphenyl]-2,2'-diol; 3-(1,1-dimethylethyl)-1,2-benzenediol; 2-(1,1-dimethylethyl)-4,6-dinitrophenol; 2,2'-butylidenebis[6-(1,1-dimethylethyl)-4-methylphenol; 4,4'-[thiobis(methylene)]bis[2,6-bis(1,1-dimethylethyl)phenol; 3-(1,1-dimethylethyl)-4-hydroxy-5-methylbenzenepropanoic acid, methyl ester; 2-(1,1-dimethylethyl)-4-(1-methylethyl)phenol; 4,4'-dithiobis[2,6-bis(1,1-dimethylethyl)]phenol; dimethylcarbamodithioic acid, [3,5-bis(1,1-dimethylethyl)-4-hydroxyphenyl]methyl ester; 2,6-bis(1,1-dimethylethyl)-4-(2-propen-1-yl)phenol; 3,5-bis(1,1-dimethylethyl)-4-hydroxybenzenepropanoic acid, nitrilotri-2,1-ethanediyl ester; 4,4'-thiobis[2,6-bis(1,1-dimethylethyl) phenol; 3,5-bis(1,1-dimethylethyl)-1,2-benzenediol; 3,5-bis(1,1-dimethylethyl)-4-hydroxybenzenepropanoic acid hydrazide; 3,5-bis(1,1-dimethylethyl)-4-hydroxybenzenepropanoic acid, ethyl ester; 3,5-bis(1,1-dimethylethyl)-4-hydroxybenzoic acid, ethyl ester; 4,4'-[oxybis(methylene)]bis[2,6-bis(1,1-dimethylethyl)phenol; 2-[2-(4-chloro-2-nitrophenyl)diazenyl]-6-(1,1-dimethylethyl)-4-methylphenol; α-[3-[3-(2Hbenzotriazol-2-yl)-5-(1,1-dimethylethyl)-4-hydroxyphenyl]-1-oxopropyl]-ω-hydroxy-poly(oxy-1,2-ethanediyl); 2,2'-methylenebis[4,6-bis(1,1-dimethylethyl)]phenol; 2,6-bis[[3-(1,1-dimethylethyl)-2-hydroxy-5-methylphenyl]methyl]-4-methylphenol; 2,6-bis(1,1-dimethylethyl)-4-nonylphenol; 3,3'-thiobispropanoicacid, 1,1'-bis[2-[3,5-bis(1,1-dimethylethyl)-4-hydroxyphenyl]ethyl]ester; 2-(1,1-dimethylethyl)-6-methyl-4-[3-[[2,4,8,10-tetrakis(1,1-dimethylethyl) dibenzo[d,f][1,3,2]dioxaphosphepin-6-yl]oxy]propyl] phenol; 2-(1,1-dimethylethyl)-1,4-Benzenediol, 4-acetate; 2,4-bis(1,1-dimethylethyl)-6-(1-phenylethyl)phenol; 3,4',5-tris(1,1-dimethylethyl)-[1,1'-Biphenyl]-4-ol; 3,3',5,5'-tetrakis(1,1-dimethylethyl)-[1,1'-Biphenyl]-2,2'-diol; 3-(2H-benzotriazol-2-yl)-5-(1,1-dimethylethyl)-4-hydroxybenzenepropanoic acid, methyl ester; 4-hydroxy-3,5-dimethylbenzonitrile; 2-[(2-hydroxy-3,5-dimethylphenyl) methyl]-4,6-dimethylphenol; 2-ethyl-6-methylphenol; 3,4-dihydro-2,2,5,7,8-pentamethyl-2H-1-benzopyran-6-ol; 4-hydroxy-3,5-dimethylbenzaldehyde; 3,4-dihydro-6-hydroxy-2,5,7,8-tetramethyl-2H-1-Benzopyran-2-carboxylic acid; 2,6-bis[(2-hydroxy-5-methylphenyl)methyl]-4-methylphenol; 2,2'-methylenebis[6-cyclohexyl-4-methylphenol]; 2,3,5,6-tetramethylphenol; 2,3,4,5,6-pentamethylphenol; and mixtures thereof.

In one aspect, preferred hindered phenols for use herein include, but are not limited to, 2,6-dimethyphenol; 2,6-diethylphenol; 2,6-bis(1-methylethyl)phenol; 2,4,6-trimethylphenol; 2-(1,1-dimethylethyl)-4-methoxyphenol; 3,5-bis(1,1-dimethylethyl)-4-hydroxy-benzoic acid; 3,5-bis(1,1-dimethylethyl)-2-hydroxy-benzoic acid; 3,5-bis(1,1-dimethylethyl)-4-hydroxy-benzenemethanol; 2-(2H-benzotriazol-2-yl)-4,6-bis(1,1-dimethylethyl)-phenol; 2-(1,1-dimethylethyl)-4-ethyl-phenol; 2-(1,1-dimethylethyl)-6-methyl-phenol; 2,2'-methylenebis[6-(1,1-dimethylethyl)-4-ethylphenol; 2,6-bis(1,1-dimethylethyl)-4-ethylphenol; 4,4'-thiobis[2-(1,1-dimethylethyl)-6-methylphenol; 3,5-bis(1,1-dimethylethyl)-4-hydroxybenzenepropanoic acid, 1,1'-[(1,2-dioxo-1,2-ethanediyl)bis(imino-2,1-ethanediyl)] ester; 2,6-bis(1,1-dimethylethyl)-4-nitrosophenol; 2,2'-thiobis[6-(1,1-dimethylethyl)-4-methylphenol; 2,6-bis(1,1-dimethylethyl)-4-(1-methylpropyl)phenol; 2,4-bis(1,1-dimethylethyl)-6-methylphenol; 2,2'-ethylidenebis[4,6-bis(1,1-dimethylethyl)]phenol; N,N'-1,3-propanediylbis[3,5-bis(1,1-dimethylethyl)-4-hydroxybenzenepropanamide; 2,6-bis(1,1-dimethylethyl)-1,4-benzenediol; 4,4'-(1-methylethylidene)bis[2-(1,1-dimethylethyl)phenol; 2-[[[3,5-bis(1,1-dimethylethyl)-4-hydroxyphenyl]methyl]thio] acetic acid, 2-ethylhexyl ester; 4-butyl-2,6-bis(1,1-dimethylethyl)phenol; phosphorous acid, 2-(1,1-dimethylethyl)-4-[1-[3-(1,1-dimethylethyl)-4-hydroxyphenyl]-1-methylethyl]phenyl bis(4-nonylphenyl) ester; 4,4'-(2,4,8,10-tetraoxaspiro[5.5]undecane-3,9-diyl)bis[2,6-bis(1,1-dimethylethyl)phenol]; 3-(5-chloro-2Hbenzotriazol-2-yl)-5-(1,1-dimethylethyl)-4-hydroxybenzenepropanoic acid, octyl ester; 4,4'-(1-methylethylidene)bis[2,6-bis(1,1-dimethylethyl)phenol; 3,5-bis(1,1-dimethylethyl)-4-hydroxybenzenepropanoic acid, 1,1',1"-[(2,4,6-trioxo-1,3,5-triazine-1,3,5(2H,4H,6H)-triyl)tri-2,1-ethanediyl] ester; 2,6-bis(1-methylethyl)phenol; 2,6-diethylphenol; 2,6-dimethyl-1,4-benzenediol; 3,3',5,5'-tetramethyl-[1,1'-Biphenyl]-4,4'-diol; 2,6-bis(1,1-dimethylethyl)-4-(1-methylpropyl)phenol; 2,2'-methylenebis[4-methyl-6-(1-methylcyclohexyl)phenol; 3,5-bis(1,1-dimethylethyl)-[1,1'-Biphenyl]-4-ol; 4-(1,1-dimethylethyl)-2,6-dimethylphenol; 2,3,4,6-tetramethylphenol; 2,4,6-tris(1-methylethyl)phenol; 2,2'-(2-methylpropylidene)bis[4,6-dimethylphenol]; and mixtures thereof.

In another aspect, highly preferred hindered phenols for use herein include, but are not limited to, 2,6-bis(1-methylpropyl)phenol; 2,6-bis(1,1-dimethylethyl)-4-methyl-phenol (also known as hydroxy butylated toluene, "BHT"); 2-(1,1-dimethylethyl)-1,4-benzenediol; 2,4-bis(1,1-dimethylethyl)-phenol; 2,6-bis(1,1-dimethylethyl)-phenol; 3,5-bis(1,1-dimethylethyl)-4-hydroxy-benzenepropanoic acid, methyl ester; 2-(1,1-dimethylethyl)-4-methylphenol; 2-(1,1-dimethylethyl)-4,6-dimethyl-phenol; 3,5-bis(1,1-dimethylethyl)-4-hydroxybenzenepropanoic acid, 1,1'-[2,2-bis[[3-[3,5-bis(1,1-dimethylethyl)-4-hydroxyphenyl]-1-oxopropoxy] methyl]-1,3-propanediyl] ester; 3,5-bis(1,1-dimethylethyl)-4-hydroxybenzenepropanoic acid, octadecyl ester; 2,2'-methylenebis[6-(1,1-dimethylethyl)-4-methylphenol; 2-(1,1-dimethylethyl)-phenol; 2,4,6-tris(1,1-dimethylethyl)-phenol; 4,4'-methylenebis[2,6-bis(1,1-dimethylethyl)-phenol; 4,4',4"-[(2,4,6-trimethyl-1,3,5-benzenetriyl)tris (methylene)]tris[2,6-bis(1,1-dimethylethyl)-phenol]; N,N'-1,6-hexanediylbis[3,5-bis(1,1-dimethylethyl)-4-hydroxybenzenepropanamide; 3,5-bis(1,1-dimethylethyl)-4-hydroxybenzoic acid, hexadecyl ester; P-[[3,5-bis(1,1-dimethylethyl)-4-hydroxyphenyl]methylphosphonic acid, diethyl ester; 1,3,5-tris[[3,5-bis(1,1-dimethylethyl)-4-hydroxyphenyl]methyl]-1,3,5-Triazine-2,4,6(1H,3H,5H)-trione; 3,5-bis(1,1-dimethylethyl)-4-hydroxybenzenepropanoic acid, 2-[3-[3,5-bis(1,1-dimethylethyl)-4-hydroxyphenyl]-1-oxopropyl]hydrazide; 3-(1,1-dimethylethyl)-4-hydroxy-5-methylbenzenepropanoic acid, 1,1'-[1,2-ethanediylbis(oxy-2,1-ethanediyl)] ester; 4-[(dimethylamino)methyl]-2,6-bis(1,1-dimethylethyl)phenol; 4-[[4,6-bis(octylthio)-1,3,5-triazin-2-yl]amino]-2,6-bis(1,1-dimethylethyl)phenol; 3,5-bis(1,1-dimethylethyl)-4-hydroxybenzenepropanoic acid, 1,1'-(thiodi-2,1-ethanediyl) ester; 3,5-bis(1,1-dimethylethyl)-4-hydroxybenzoic acid, 2,4-bis(1,1-dimethylethyl)phenyl ester; 3,5-bis(1,1-dimethylethyl)-4-hydroxybenzenepropanoic acid, 1,1'-(1,6-hexanediyl)ester; 3-(1,1-dimethylethyl)-4-hydroxy-5-methylbenzenepropanoic acid, 1,1'-[2,4,8,10-tetraoxaspiro[5.5]undecane-3,9-diylbis(2,2-dimethyl-2,1-ethanediyl)] ester; 3-(1,1-dimethylethyl)-β-[3-(1,1-dimethylethyl)-4-hydroxyphenyl]-4-hydroxy-β-methylbenzenepropanoic acid, 1,1'-(1,2-ethanediyl) ester; 2-[[3,5-bis(1,1-dimethylethyl)-4-hydroxyphenyl]methyl]-2-butylpropanedioic acid, 1,3-bis(1,2,2,6,6-pentamethyl-4-piperidinyl) ester; 3,5-bis(1,1-dimethylethyl)-4-hydroxybenzenepropanoic acid, 1-[2-[3-[3,5-bis(1,1-dimethylethyl)-4-hydroxyphenyl]-1-oxopropoxy]ethyl]-2,2,6,6-tetramethyl-4-piperidinyl ester; 3,4-dihydro-2,5,7,8-tetramethyl-2-[(4R,8R)-4,8,12-trimethyltridecyl]-(2R)-2H-1-benzopyran-6-ol; 2,6-dimethylphenol; 2,3,5-trimethyl-1,4-benzenediol; 2,4,6-trimethylphenol; 2,3,6-trimethylphenol; 4,4'-(1-methylethylidene)-bis[2,6-dimethylphenol]; 1,3,5-tris[[4-(1,1-dimethylethyl)-3-hydroxy-2,6-dimethylphenyl]methyl]-1,3,5-triazine-2,4,6(1H,3H,5H)-trione; 4,4'-methylenebis[2,6-dimethylphenol]; and mixtures thereof.

In another aspect, highly preferred hindered phenols for use herein may also include 2-(1,1-dimethylethyl)-4-methoxyphenol, 3,5-bis(1,1-dimethylethyl)-4-hydroxy-benzoic acid, 3,5-bis(1,1-dimethylethyl)-2-hydroxy-benzoic acid, 3,5-bis(1,1-dimethylethyl)-4-hydroxy-benzenemethanol, 2-(2H-benzotriazol-2-yl)-4,6-bis(1,1-dimethylethyl)-phenol, 2-(1,1-dimethylethyl)-4-ethyl-phenol, 2-(1,1-dimethylethyl)-6-methyl-phenol, 3-(1,1-dimethylethyl)-1,2-benzenediol, 2,2'-methylenebis[6-(1,1-dimethylethyl)-4-ethylphenol, 2,6-bis(1,1-dimethylethyl)-4-ethylphenol, 4,4'-thiobis[2-(1,1-dimethylethyl)-6-methylphenol, 2-(1,1-dimethylethyl)-4,6-dinitrophenol, 2,6-bis(1,1-dimethylethyl)-4-nitrosophenol, 2,2'-thiobis[6-(1,1-dimethylethyl)-4-methylphenol, 2,6-bis(1,1-dimethylethyl)-4-(1-methylpropyl)phenol, 2,2'-butylidenebis[6-(1,1-dimethylethyl)-4-methylphenol, 2,4-bis(1,1-dimethylethyl)-6-methylphenol, 4,4'-[thiobis(methylene)]bis[2,6-bis(1,1-dimethylethyl)phenol, 2,2'-ethylidenebis[4,6-bis(1,1-dimethylethyl)]phenol, N,N'-1,3-propanediylbis[3,5-bis(1,1-dimethylethyl)-4-hydroxybenzenepropanamide, 3-(1,1-dimethylethyl)-4-hydroxy-5-methylbenzenepropanoic acid, methyl ester, 2-(1,1-dimethylethyl)-4-(1-methylethyl)phenol, 2,6-bis(1,1-dimethylethyl)-1,4-benzenediol, 4,4'-(1-methylethylidene)bis[2-(1,1-dimethylethyl)phenol, 4,4'-dithiobis[2,6-bis(1,1-dimethylethyl)]phenol, dimethylcarbamodithioic acid, [3,5-bis(1,1-dimethylethyl)-4-hydroxyphenyl]methyl ester, 2-[[[3,5-bis(1,1-dimethylethyl)-4-hydroxyphenyl]methyl]thio]acetic acid, 2-ethylhexyl ester, 3-(5-chloro-2Hbenzotriazol-2-yl)-5-(1,1-dimethylethyl)-4-hydroxybenzenepropanoic acid, methyl ester, 4-butyl-2,6-bis(1,1-dimethylethyl)phenol, 2,6-bis(1,1-dimethylethyl)-4-(2-propen-1-yl)phenol, phosphorous acid, 2-(1,1-dimethylethyl)-4-[1-[3-(1,1-dimethylethyl)-4-hydroxyphenyl]-1-methylethyl]phenyl bis(4-nonylphenyl) ester, 4,4'-(2,4,8,10-tetraoxaspiro[5.5]undecane-3,9-diyl)bis[2,6-bis(1,1-dimethylethyl)phenol], 3-(5-chloro-2Hbenzotriazol-2-yl)-5-(1,1-dimethylethyl)-4-hydroxybenzenepropanoic acid, octyl ester, 3,5-bis(1,1-dimethylethyl)-4-hydroxybenzenepropanoic acid, nitrilotri-2,1-ethanediyl ester, 4,4'-thiobis[2,6-bis(1,1-dimethylethyl)phenol, 4,4'-(1-methylethylidene)bis[2,6-bis(1,1-dimethylethyl)phenol, 3,5-bis(1,1-dimethylethyl)-4-hydroxybenzenepropanoic acid, 1,1',1"-[(2,4,6-trioxo-1,3,5-triazine-1,3,5(2H,4H,6H)-triyl)tri-2,1-ethanediyl] ester, 2,6-bis(1-methylethyl)phenol, 2,6-diethylphenol, 2-ethyl-6-methylphenol, 3,3',5,5'-tetramethyl-[1,1'-Biphenyl]-4,4'-diol, 3,4-dihydro-2,2,5,7,8-pentamethyl-2H-1-benzopyran-6-ol, 2,2'-methylenebis[4-methyl-6-(1-methylcyclohexyl)phenol, 3,5-bis(1,1-dimethylethyl)-[1,1'-Biphenyl]-4-ol, 4-(1,1-dimethylethyl)-2,6-dimethylphenol, 2,3,4,6-tetramethylphenol, 2,2'-(2-methylpropylidene)bis[4,6-dimethylphenol], and mixtures thereof.

Preferably, the hindered phenol is selected from the group consisting of 2,6-bis(1,1-dimethylethyl)-4-methyl-phenol; 6-tocopherol; $C_1$-$C_{18}$ linear or branched alkyl esters of 3,5-bis(1,1-dimethylethyl)-4-hydroxy-benzenepropanoic acid; and mixtures thereof. Preferred examples of $C_1$-$C_{18}$ linear or branched alkyl esters of 3,5-bis(1,1-dimethylethyl)-4-hydroxy-benzenepropanoic acid include 3,5-bis(1,1-dimethylethyl)-4-hydroxy-benzenepropanoic acid, methyl ester (commercially available under the tradename RALOX® 35 from Raschig USA, Arlington, Tex., United States), and 3,5-bis(1,1-dimethylethyl)-4-hydroxy-benzenepropanoic acid, octadecyl ester (commercially available under the tradename TINOGARD® TS from BASF, Ludwigshafen, Germany).

In a preferred non-limiting example, the hindered phenol may be 2,6-bis(1,1-dimethylethyl)-4-methyl-phenol.

Process of Making

Those skilled in the art will know how to make a water-soluble unit dose article and laundry detergent composition according to the present invention using techniques known in the art.

Use

A further aspect of the present invention is a use of an alkylated phenol or hindered phenol antioxidant to reduce malodors on fabrics wherein the fabric comprises at least one source of malodor The wash liquor comprises a metal ion, preferably $Cu^{2+}$. The metal ion may be present on the fabric before the fabric is contacted with the wash liquor. The metal ion may be present in the source of malodor on the fabric before the fabric is combined to the wash liquor. The metal ion may be present in the wash liquor when combined with the fabric. If present in the wash liquor, the metal ion may be present in the laundry detergent, the water or a mixture thereof. The source of malodor may comprise the metal ion at the point the source of malodor is applied to the fabric. Alternatively, the source of malodor may be applied to the fabric and the metal ion applied later.

Preferably, the at least one source of malodor comprises a metal ion, more preferably $Cu^{2+}$.

A further aspect of the present invention is the use of a process according to the present invention to reduce malodor on fabrics in a wash liquor and wherein the fabrics comprise at least one source of malodor and wherein the wash liquor comprises a metal ion, preferably $Cu^{2+}$.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

TEST METHODS

Malodor Reduction Test Method

The following method is used to test the malodor reduction benefits of a composition.

A. Preparation of 75 Grams Malodor Marker

Fatty acids and malodor markers are added into 100 ml glass gar with Teflon-lined cap according to Table A and mixed well using a vortex.

TABLE A

Malodor marker composition

| Material | CAS # | % Composition | Weight needed (g) |
|---|---|---|---|
| Iso Valeric acid | 503-74-2 | 12.00 | 9.0 |
| Undecanal | 112-44-7 | 0.20 | 0.15 |
| Undecanoic Acid | 112-37-8 | 62.80 | 47.1 |
| Skatole | 83-34-1 | 1.00 | 0.75 |
| Decanoic Acid | 334-48-5 | 22.00 | 16.5 |
| Ethyl undecanoate | 627-90-7 | 2.00 | 1.5 |

B. Preparation of Body Soil Malodor Composition

Provided the specified amount of each material according to Table B into a 200 mL glass jar with Teflon lined cap. Artificial body soil (ABS) is commercially available by Accurate Product Development; 2028 Bohlke Blvd, Fairfield, Ohio 45014.

TABLE B

Body soil malodor composition

| Material | Weight (g) |
|---|---|
| Malodor marker (from Table A) | 17.1 |
| Artificial Body Soil (ABS) | 15.8 |
| Di-propylene glycol monomethyl ether (CAS: 34590-94-8) | 105 |
| Squalene (CAS # 111-02-4) | 15.8 |

C. Preparation of Malodor Test Fabrics

Sixteen malodor test fabrics per wash load are prepared by applying 300 μl of Body soil malodor composition described in Table B to de-sized 2×5 inch white polycotton 50/50 (PCW50/50) swatches. 48 grams of liquid detergent to be tested (see, e.g., Example 1, Table 1, below) is added to Duet 9200 washing appliance set to Normal cycle; 77° F. wash cycle followed by a 60° F. rinse cycle. Cincinnati, Ohio, USA Municipal tap water is used, which contains an ambient level of copper, due to copper piping systems, for example. Malodor test fabrics are washed in 7 gpg wash water with 3.9 kg, 50×50 cm clean cotton and poly-cotton ballast then dried in a Maytag double stack tumble drier set to low for 20 minutes. The dried fabrics are placed in a mylar bag and sealed for 24 hours.

D. Analytical Detection of Malodor on Fabric

The malodor reduction using ABS/Squalene malodor sensors are quantitatively determined by Gas Chromatography Mass Spectroscopy using an Agilent gas chromatograph 7890B equipped with a mass selective detector (5977B), a Chemstation quantitation package and a Gerstel multi-purpose sampler equipped with a solid phase micro-extraction (SPME) probe. Calibration standards of 6-Methyl-5-hepten-2-one (CAS 110-93-0), Trans-2-heptenal (18829-55-5) and 3-methyl-2-Butenal (107-86-8) are prepared by dissolving a known weight of these materials in light mineral oil (CAS 8020-83-5) (each material available from Sigma Aldrich). Fabrics are cut into uniform 2 inch by 2.5 inch pieces and placed in 10 mL headspace crimp vials. Vials are equilibrated greater than 12 hours before analysis. The following settings are used in the auto sampler: 80 C incubation temperature, 90 min incubation time, VT32-10 sample tray type, 22 mm vial penetration, 20 min extraction time, 54 mm injection penetration and 300 s desorption time. The following settings are used for the Front Split/Splitless inlet helium: split mode, 250 C temperature, 12 psi pressure, 79.5 mL/min total flow, 3 mL/min septum purge flow, 50:1 split ratio and 22.5 min GC run time. The follow settings are used in the oven: 40 C initial temperature, 12 C/min heating program, 250 C temperature and 5 min hold time. Based on the partition coefficients (K at 80 C) of each component, the total nMol/L liter of 6-Methyl-5-hepten-2-one (K=3353), Trans-2-heptenal (K=3434), and 3-methyl-2-Butenal (K=1119) are calculated.

These values of these three measurements (in nmoles/L) are added together to provide the Total ABS/Squalene Markers (nmoles/L) for a given test leg.

E. % Malodor Reduction Oxidation Products Calculations

The % Malodor Reduction Oxidation Products is provided as a percentage comparing the reduction of the amount of selected malodor markers as provided by the test composition compared to the (nil-antioxidant) reference composition. The value is determined as follows:

$$\%\ \text{Reduction Oxidation Products} = (\text{Markers}_{ref} - \text{Markers}_{test}) \times 100/\text{Markers}_{ref}$$

Values for $\text{Markers}_{ref}$ and $\text{Markers}_{test}$ are defined as follows:

$\text{Markers}_{ref}$=Total ABS/Squalene Markers (nmoles/L) of the fabrics washed with the formulation without antioxidant (e.g., the reference or control formulation)

$\text{Markers}_{test}$=Total ABS/Squalene Markers (nmoles/L) of the fabrics washed with the formulation with the tested antioxidant As the measured oxidation products are typically considered malodorous, it is believed that the greater the % reduction of oxidation products provided by a composition, the less malodorous the treated fabrics are likely to be. Therefore, greater values of % Malodor Reduction Oxidation Products are typically preferred. The compositions and processes of the present disclosure may provide a % Malodor Reduction Oxidation Products value of at least about 10%, or at least about 20%, or at least about 30%, or at least about 40%, or at least about 50%, or at least about 60%, or at least about 70%, or at least about 80%.

Malodor reduction may also be reported as the difference between $\text{Markers}_{ref}$ and $\text{Markers}_{test}$, thereby showing an absolute difference (e.g., Delta ABS/Squalene Oxidation).

Test Method for Determining the Logarithm of the Octanol/Water Partition Coefficient at pH 7 (Log D)

The value of the log of the Octanol/Water Partition Coefficient at pH 7.00 (log D) is determined for each antioxidant. The unit-less value for log D at pH 7 for a known antioxidant is obtained from Chemical Abstracts Service (CAS, Columbus, Ohio, USA) if available. CAS provides values calculated using Advanced Chemistry Development (ACD/Labs) Software V11.02 (© 1994-2019 ACD/Labs). If the value is not available from CAS, the value is determined using ACD software (version 14.02 (Linux) available from Advanced Chemistry Development Inc., ACD/Labs, Toronto, Canada) employing the default log P Consenses and pKa Classic algorithms for the log D calculation.

Antioxidants of the present invention have a log D at pH 7.00 greater than or equal to one or more claimed values (CV). If the log D is not listed for an antioxidant compound of interest from information available from Chemical Abstracts Service (CAS, Columbus, Ohio, USA), it may be calculated directly using the ACD software.

If the value of the calculated log D at pH 7, obtained from CAS if available, or calculated with the software, is less than CV−0.50, or is not listed and is determined via calculation using ACD software to have a log D at pH 7 less than CV−0.50, no measurement of the experimental value is required. If the value of the calculated log D at pH 7 is already listed as being equal to or greater than CV−0.50 and less than or equal to CV+0.50, or is not listed and is determined via calculation using ACD software to have a log D at pH 7 equal to or greater than CV−0.50 and less than or equal to CV+0.50, then an experimental determination of the value must be performed to arrive at the value for the purposes of this invention. In the present invention, the measure of octanol-water partition coefficient is to be accomplished according to OECD Test No. 117: Partition Coefficient (n-octanol/water), HPLC Method. The method is available from the OECD iLibrary (https://www.oecd-ilibrary.org/), the online library of the Organisation for Economic Cooperation and Development (OECD).

Reverse phase HPLC is performed on analytical columns packed with a solid phase containing long hydrocarbon chains chemically bound onto silica. The chemicals are retained in the column in proportion to their hydrocarbon-water partition coefficient, with hydrophilic chemicals eluted first and lipophilic chemicals last. The HPLC method covers log Pow in the range of 0 to 6, but it can be expanded to cover the log Pow range between 6 and 10 in exceptional cases. The HPLC operation mode is isocratic. The test substance is injected in the smallest detectable quantities in the column. The retention time is determined in duplicate. The partition coefficient of the test substance is obtained by interpolation of the calculated capacity factor on the calibration graph. For very low and very high partition coefficients extrapolation is necessary.

The pH of the eluent is critical for ionizable substances. For the purposes of the present invention, buffering of the eluant to pH 7.00±0.05 is required when performing the OECD 117 test. The value obtained is taken to be the log D at pH 7 for the material of interest.

EXAMPLES

The example provided below is intended to be illustrative in nature and is not intended to be limiting.

Example 1. Exemplary Formulations (Heavy Duty Liquid Laundry Detergents)

The following heavy duty liquid laundry detergent compositions may be prepared by traditional means known to those of ordinary skill in the art by mixing the listed ingredients Table 1. Composition 1A is a conventional premium laundry detergent that contains no antioxidants of the present disclosure. Compositions 1B through 1H are prepared from 1A by addition of 0.035 wt % of the indicated antioxidant.

TABLE 1

| Wt % Active ingredients in Compositions 1A to 1H | | | | | | | | |
|---|---|---|---|---|---|---|---|---|
| Raw Material | 1A | 1B | 1C | 1D | 1E | 1F | 1G | 1H |
| C12-15 alkyl EO1.8 sulfate | | | | 11.7 | | | | |
| Alkyl benzene sulfonate[1] | | | | 7.2 | | | | |

TABLE 1-continued

| Wt % Active ingredients in Compositions 1A to 1H | | | | | | | | |
|---|---|---|---|---|---|---|---|---|
| Raw Material | 1A | 1B | 1C | 1D | 1E | 1F | 1G | 1H |
| C12-14 Amine Oxide | | | | 0.7 | | | | |
| C12-14 EO9[2] | | | | 5 | | | | |
| Citric Acid | | | | 2.1 | | | | |
| C12-18 Fatty Acid | | | | 0.9 | | | | |
| Sodium hydroxide | | | | 0.2 | | | | |
| Chelant[3] | | | | 0.47 | | | | |
| Mono-ethanolamine | | | | 2.9 | | | | |
| Diethylene glycol | | | | 2.4 | | | | |
| 1,2-Propanediol | | | | 2.1 | | | | |
| Borate | | | | 1 | | | | |
| Ethanol | | | | 1.5 | | | | |
| Sorbitol | | | | 0.06 | | | | |
| Na Cumene Sulfonate | | | | 0.15 | | | | |
| Ethoxylated PEI[4] | | | | 1.5 | | | | |
| Amphiphilic alkoxylated grease cleaning polymer[5] | | | | 1.3 | | | | |
| Calcium formate | | | | 0.1 | | | | |
| Sodium Chloride | | | | 0.03 | | | | |
| Protease[6] | | | | 0.068 | | | | |
| Mannanase[7] | | | | 0.002 | | | | |
| Amalyse[7] | | | | 0.007 | | | | |
| Fluorescent Whitening Agents[8] | | | | 0.3 | | | | |
| V200 Whiteness Dye | | | | 0.025 | | | | |
| Perfume | | | | 0.6 | | | | |
| Hydrogenated Castor Oil | | | | 0.1 | | | | |
| Phenoxyethanol | | | | 0.001 | | | | |
| Benz-isothiazolinone | | | | 0.001 | | | | |
| Aesthetic dye | | | | 0.01 | | | | |
| DC1520 Silicone Suds suppressor | | | | 0.003 | | | | |
| AF8017 Silicone Suds suppressor | | | | 0.2 | | | | |
| Antioxidant 1[9] | — | 0.035 | — | — | — | — | — | — |
| Antioxidant 2[10] | — | — | 0.035 | — | — | — | — | — |
| Antioxidant 3[11] | — | — | — | 0.035 | — | — | — | — |
| Antioxidant 4[12] | — | — | — | — | 0.035 | — | — | — |
| Antioxidant 5[13] | — | — | — | — | — | 0.035 | — | — |
| Antioxidant 6[14] | — | — | — | — | — | — | 0.035 | — |
| Antioxidant 7[15] | — | — | — | — | — | — | — | 0.035 |
| Water/Misc. | | | | Balance | | | | |

1. Linear alkylbenzenesulfonate having an average aliphatic carbon chain length C11-C12 supplied by Stepan, Northfield, Illinois, USA
2. AE9 is C12-14 alcohol ethoxylate, with an average degree of ethoxylation of 9, supplied by Huntsman, Salt Lake City, Utah, USA
3. Diethylenetetraamine pentaacetic acid (DTPA) supplied by Dow Chemical, Midland, Michigan, USA; Hydroxyethane diphosphonate (HEDP) supplied by Solutia, St Louis, Missouri, USA, or Tetrasodium glutamate diacetate (GLDA), supplied by AkzoNobel, Amsterdam, The Netherlands, or Diethylenetriamine (DETA), supplied by Huntsman, The Woodlands, Texas, US, may also be used.
4. Polyethyleneimine (MW = 600) with 20 ethoxylate groups per —NH.
5. Amphiphilic alkoxylated grease cleaning polymer is a polyethyleneimine (MW = 600) with 24 ethoxylate groups per —NH and 16 propoxylate groups per —NH.
6. Proteases may be supplied by Genencor International, Palo Alto, California, USA (e.g. Purafect Prime ® or by Novozymes, Bagsvaerd, Denmark (e.g. Liquanase ®, Coronase ®).
7. Natalase ®, Mannaway ® are all products of Novozymes, Bagsvaerd, Denmark.
8. Suitable Fluorescent Whitening Agents are for example, Tinopal ® AMS, Tinopal ® CBS-X
9. Methyl (3,5-di-tert-butyl-4-hydroxyphenyl)propionate, CAS 6386-38-5
10. 3,5-bis(1,1-dimethylethyl)-4-hydroxybenzenepropanoic acid, 1,1'-[2,2-bis[[3-[3,5-bis(1,1-dimethylethyl)-4-hydroxyphenyl]-1-oxopropoxy]methyl]-1,3-propanediyl] ester, CAS 6683-19-8
11. N,N'-1,6-hexanediylbis[3,5-bis(1,1-dimethylethyl)-4-hydroxybenzenepropanamide, CAS 23128-74-7
12. 1,3,5-tris[[3,5-bis(1,1-dimethylethyl)-4-hydroxyphenyl]methyl]-1,3,5-Triazine-2,4,6(1H,3H,5H)-trione, CAS 27676-62-6
13. Alpha-tocopherol (3,4-dihydro-2,5,7,8-tetramethyl-2-(4,8,12-trimethyltridecyl)-2H-1-Benzopyran-6-ol), CAS 10191-41-0
14. Chromanol (3,4-dihydro-2,2,5,7,8-pentamethyl-2H-1-Benzopyran-6-ol), CAS 950-99-2
15. 3,4-dihydro-6-hydroxy-2,5,7,8-tetramethyl-2H-1-Benzopyran-2-carboxylic acid, CAS 53188-07-1

Example 2. Control of Malodor by Use of Antioxidants

To show the malodor control effects of antioxidants of the present disclosure, various liquid detergent compositions are prepared according to Example 1, Table 1, above. The compositions are tested for % Reduction Oxidation Products according to the test method provided above. Results are shown in Table 2.

TABLE 2

Impact of hindered phenols at 0.035 wt % on malodor marker formation.

| Comp. | Antioxidant Structure | ACD Labs logD (pH 7) | Total ABS/Squalene markers (nmoles/L) | % Reduction |
|---|---|---|---|---|
| 1A | — | — | 139.8 | — |
| 1B | 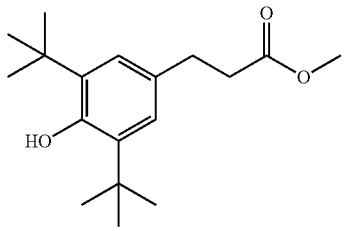 | 4.87 | 39.2 | 72.0 |
| 1C | 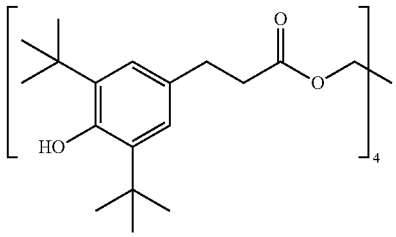 | 18.83 | 16.8 | 88.0 |
| 1D | 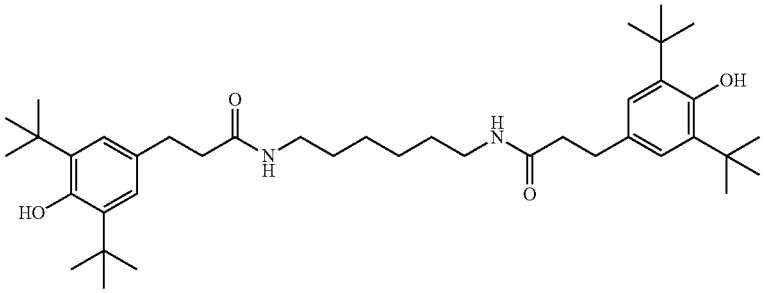 | 9.82 | 14.6 | 89.6 |
| 1E | 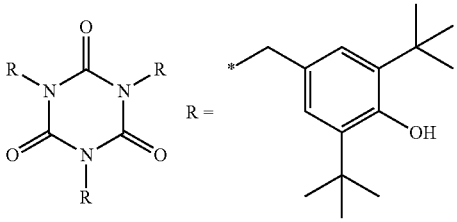 | 11.40 | 41.5 | 70.3 |
| 1F | 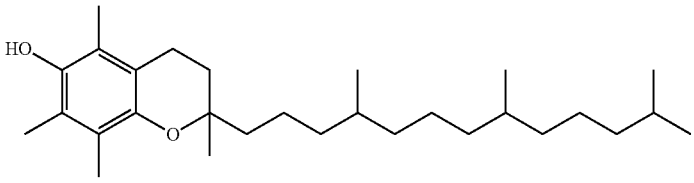 | 10.96 | 29.9 | 78.6 |

TABLE 2-continued

Impact of hindered phenols at 0.035 wt % on malodor marker formation.

| Comp. | Antioxidant Structure | ACD Labs logD (pH 7) | Total ABS/Squalene markers (nmoles/L) | % Reduction |
|---|---|---|---|---|
| 1G | 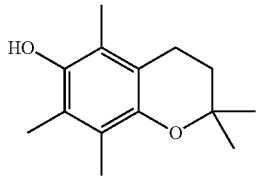 | 3.79 | 5.7 | 95.9 |
| 1H | 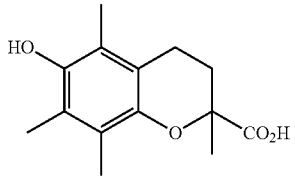 | −0.93 | 143.4 | −2.6 |

The results demonstrate that while a wide variety of such structures provide a significant reduction in the total oxidation markers detected, not all antioxidants do so. The antioxidant in TH having an ionizable carboxylic acid group failed to show benefits. Compositions 1F and 1G have antioxidants with very similar structures with respect to the phenol moiety, but have no groups easily ionized at neutral pH or other strongly solubilizing groups. The antioxidant used in Composition 1H has a calculated log D value of −0.93 at pH 7(calculated using Advanced Chemistry Development (ACD/Labs) Software V11.02), meaning it is almost 10 times more likely to be in water than in octanol when the water is at pH 7 and the volumes of water and octanol are the same. The other hindered phenol antioxidants employed, including those in Compositions 1F and 1G, have log D values ranging from 3.79 to 18.83 at pH 7. Given that body soils are largely hydrophobic, it is perhaps understandable why a more highly water soluble material like 3,4-dihydro-6-hydroxy-2,5,7,8-tetramethyl-2H-1-Benzopyran-2-carboxylic acid used in formulation 9H did not provide benefits—it has little driving force to partition into the hydrophobic soil, which it must do if it is to impact autoxidation events in that soil post-wash.

Example 3. Impact of $Cu^{2+}$ on Malodor

This example demonstrates that the presence of copper in the wash meaningfully impacts the amount of subsequent post-wash autoxidation leading to detectable malodor. Four concurrent washes of standard body soil swatches were performed using 1000 ppm commercially available Tide liquid detergent where three of the wash solutions were spiked with 400, 800, or 1200 ppb of copper. The fourth wash had no copper added and served as the control leg.

Analysis of the washed and dried swatches to determine the levels of the malodor markers (3-methyl-2-butenal, trans-2-methyl-heptenal and 6-methyl-5-hepten-2-one) showed that adding copper to the wash resulted in an increase in the level of malodor markers generated, as shown in Table 3 below.

TABLE 3

Impact of copper ions in the wash on malodor generation.

| Treatment | Added $Cu^{2+}$ (ppb) | ABS/Squalene markers (nmoles/L) |
|---|---|---|
| A | 0 | 62 |
| B | 200 | 120 |
| C | 400 | 162 |
| D | 800 | 163 |

Interestingly, adding more copper beyond 400 ppb did not further increase the level of the markers detected, indicating perhaps that 400 ppb copper was enough to maximize the subsequent autoxidation of the soil that was present. For any given level of soil remaining on fabric, it is reasonable to assume there is a corresponding maximum amount of malodor markers that can be generated from that soil.

The dimensions and values disclosed herein are not to be understood as being strictly limited to the exact numerical values recited. Instead, unless otherwise specified, each such dimension is intended to mean both the recited value and a functionally equivalent range surrounding that value.

For example, a dimension disclosed as "40 mm" is intended to mean "about 40 mm." Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A process of reducing malodors on fabrics, comprising:

combining fabrics with a wash liquor;

washing the fabrics in the wash liquor using an automatic wash operation, a manual wash operation or a mixture thereof;

separating the fabrics and the wash liquor from one another; and drying the fabrics, wherein:

the fabrics comprise at least one source of malodor, the wash liquor comprises from 200 to 800 ppb $Cu^{2+}$, the wash liquor is prepared by diluting a laundry detergent composition in water by a factor of between 100-fold and 3000-fold, the laundry detergent composition comprises from 0.025% to 5% by weight of the laundry detergent composition of $C_1$-$C_{18}$ linear or branched alkyl esters of 3,5-bis(1,1-dimethylethyl)-4-hydroxy-benzenepropanoic acid antioxidant, and wherein said antioxidant has a log D value at pH 7 equal to or greater than 1.50.

2. The process according to claim 1, wherein the laundry detergent composition is diluted in water by a factor of between 300-fold and 900-fold.

3. The process according to claim 1, wherein the laundry detergent composition comprises from 0.025% to 1.5% by weight of the laundry detergent composition of the $C_1$-$C_{18}$ linear or branched alkyl esters of 3,5-bis(1,1-dimethylethyl)-4-hydroxy-benzenepropanoic acid.

4. The process according to claim 1, wherein said antioxidant has a log D value at pH 7 equal to or greater than 3.50.

5. The process according to claim 1, wherein the metal ion $Cu^{2+}$ is introduced to the wash liquor by being present on the fabric prior to contacting with the wash liquor, being present in the water used to make the wash liquor, or a mixture thereof.

6. The process according to claim 1, a. wherein the fabrics are washed in the wash liquor at a temperature of between 10° C. and 35° C.;

b. wherein the automatic wash operation takes between 5 minutes and 30 minutes;

c. or a mixture thereof.

7. The process according to claim 1, wherein the wash liquor comprises from 0.1 ppm to 100 ppm of the $C_1$-$C_{18}$ linear or branched alkyl esters of 3,5-bis(1,1-dimethylethyl)-4-hydroxy-benzenepropanoic acid.

8. The process according to claim 1, wherein the laundry detergent composition comprises a non-soap surfactant, wherein the non-soap surfactant is selected from the group consisting of a non-soap anionic surfactant, non-ionic surfactant, amphoteric surfactant, cationic surfactant, or a mixture thereof, wherein the laundry detergent composition comprises between 20% and 55% by weight of the laundry detergent composition of the non-soap surfactant.

9. The process according to claim 8, wherein the non-soap anionic surfactant comprises a mixture of a linear alkylbenzene sulphonate and an alkoxylated alkyl sulphate, wherein the weight ratio of linear alkylbenzene sulphonate to ethoxylated alkyl sulphate is from 1.4:1 to 3:1, wherein the laundry detergent composition comprises between 30% and 40% by weight of the detergent composition of the non-soap anionic surfactant.

10. The process according to claim 1, wherein the laundry detergent composition comprises between 0.15% and 4% by weight of the laundry detergent composition of a non-ionic surfactant, wherein the non-ionic surfactant is selected from the group consisting of an alcohol alkoxylate, an oxo-synthesised alcohol alkoxylate, Guerbet alcohol alkoxylates, alkyl phenol alcohol alkoxylates and mixtures thereof.

11. The process according to claim 1, wherein the laundry detergent composition comprises between 4% and 8% by weight of the laundry detergent composition of an amine neutralized fatty acid salt, wherein the amine is a monoethanolamine.

12. The process according to claim 1, wherein the laundry detergent comprises an additional ingredient selected from the group consisting of cationic polymers, polyester terephthalates, amphiphilic graft co-polymers, carboxymethylcellulose, enzymes, perfumes, encapsulated perfumes, bleach and mixtures thereof.

13. The process according to claim 1, wherein the laundry detergent composition further comprises a chelant, wherein the chelant is selected from the group consisting of phosphonates, aminocarboxylates, amino phosphonates, polyfunctionally-substituted aromatic chelating agents, and mixtures thereof.

14. The process according to claim 1, wherein the laundry detergent composition further comprises a hueing dye.

15. The process according to claim 1, wherein the $C_1$-$C_{18}$ linear or branched alkyl esters of 3,5-bis(1,1-dimethylethyl)-4-hydroxy-benzenepropanoic acid has a log D value at pH 7 equal to or greater than 2.50.

* * * * *